US005094636A

United States Patent [19]

Zinn et al.

[11] Patent Number: 5,094,636

[45] Date of Patent: Mar. 10, 1992

[54] ELECTRICAL CONTACT ELEMENT WITH A COVER SPRING

[75] Inventors: Bernd Zinn, Ennepetal; Sbroslav Lolic, Wuppertal, both of Fed. Rep. of Germany

[73] Assignee: Grote & Hartmann GmbH & Co. KG, Fed. Rep. of Germany

[21] Appl. No.: 623,606

[22] Filed: Dec. 7, 1990

[30] Foreign Application Priority Data

Dec. 18, 1989 [DE] Fed. Rep. of Germany ... 8914951[U]

[51] Int. Cl.[5] ..... H01R 13/00

[52] U.S. Cl. ..... 439/839

[58] Field of Search ..... 439/839, 851, 856, 857, 439/861, 862

[56] References Cited

U.S. PATENT DOCUMENTS 4,540,235 9/1985 Lolic ..... 439/839
4,583,812 4/1986 Gross, Jr. et al. ..... 439/839
4,932,877 6/1990 Zinn ..... 439/839

FOREIGN PATENT DOCUMENTS 250468 11/1966 Austria ..... 439/839
8903129 4/1989 PCT Int'l Appl. ..... 439/839

*Primary Examiner*—Joseph H. McGlynn
*Attorney, Agent, or Firm*—Jones, Askew & Lunsford

[57] ABSTRACT

An electrical contact element having a contact base, and with a cover-spring provided on and affixed to the contact base. The contact element forms a one-piece punched/bent component of sheet metal with a connector part formed by a crimped member, and with a tubular contact base extending forwardly therefrom. The cover-spring is designed in two pieces, each cover-spring piece having a cover-spring base part. Those base parts are affixed to the contact base opposite each other in relation to the longitudinal midaxis of the contact base.

32 Claims, 6 Drawing Sheets

FIG.3
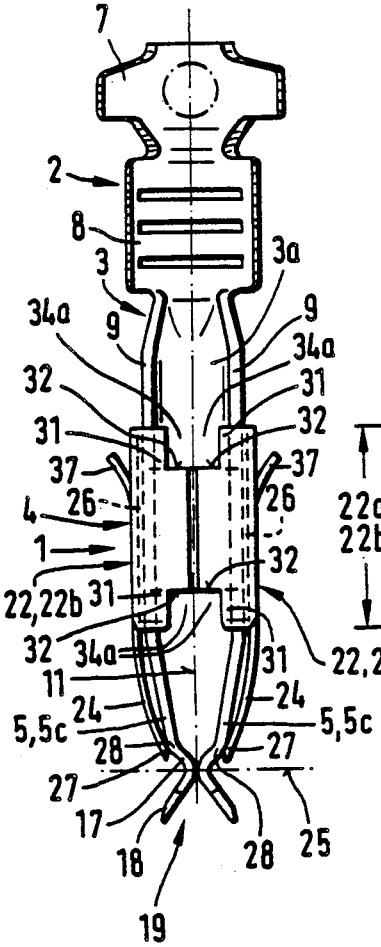
FIG.1
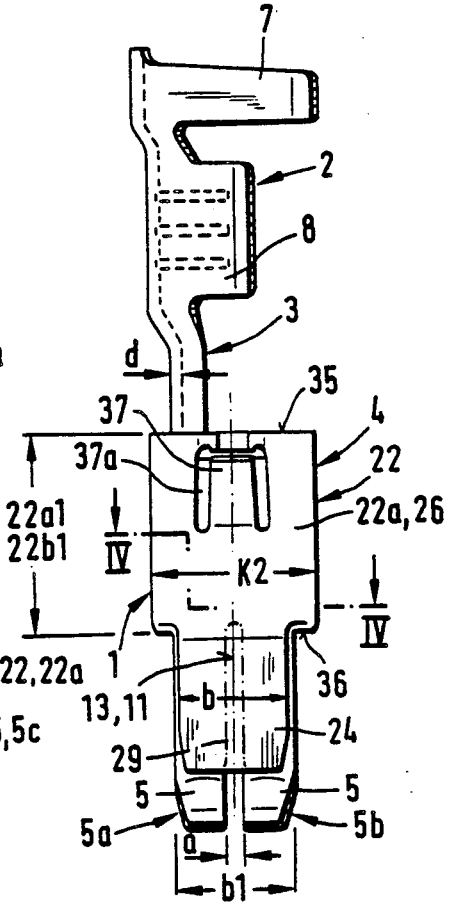
FIG.2
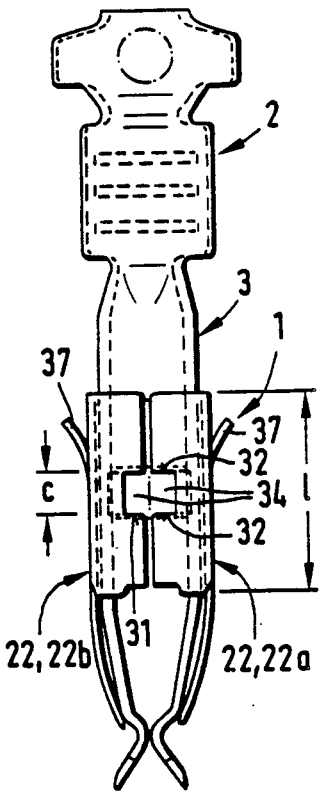
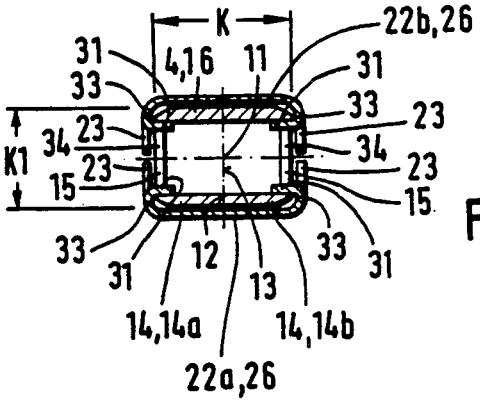
FIG.4

FIG.7
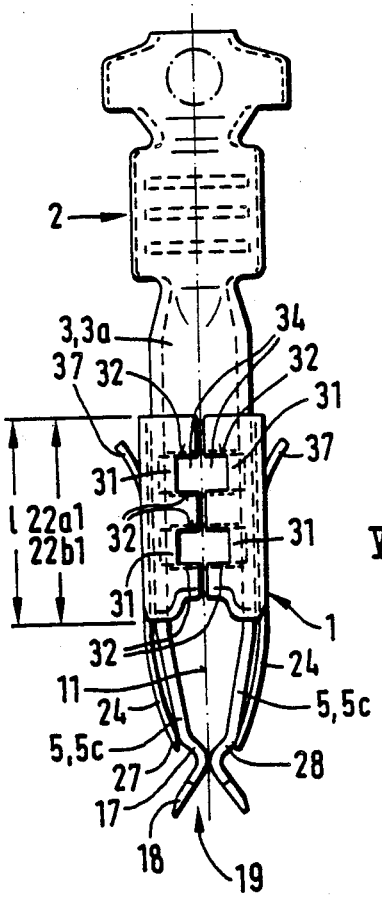
FIG.5
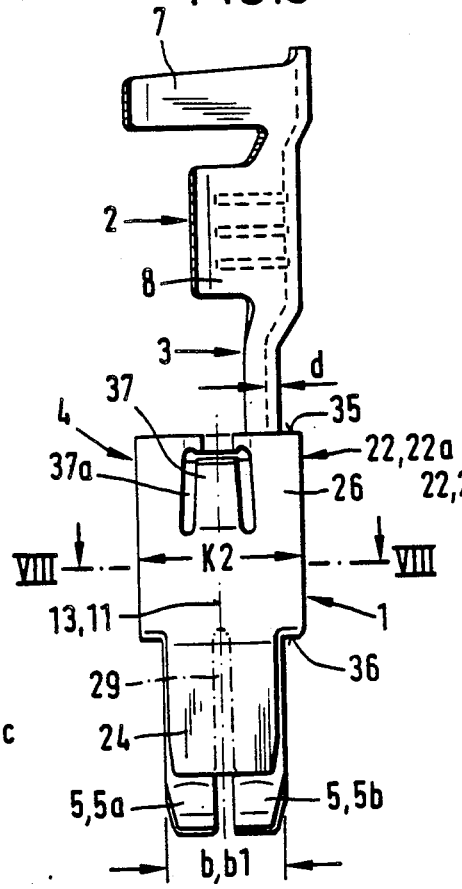
FIG.6
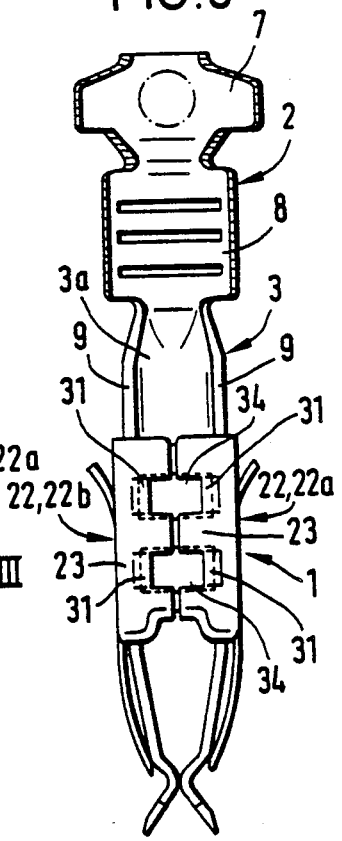
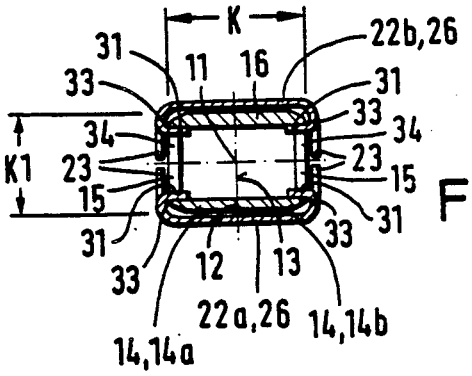
FIG.8

FIG.11
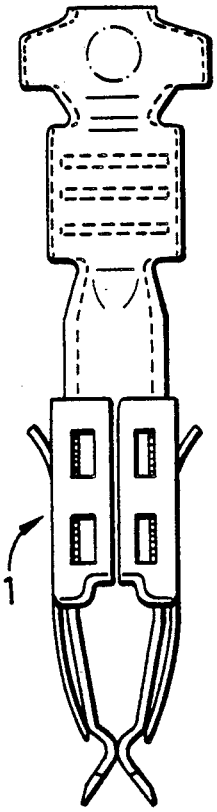
FIG.9
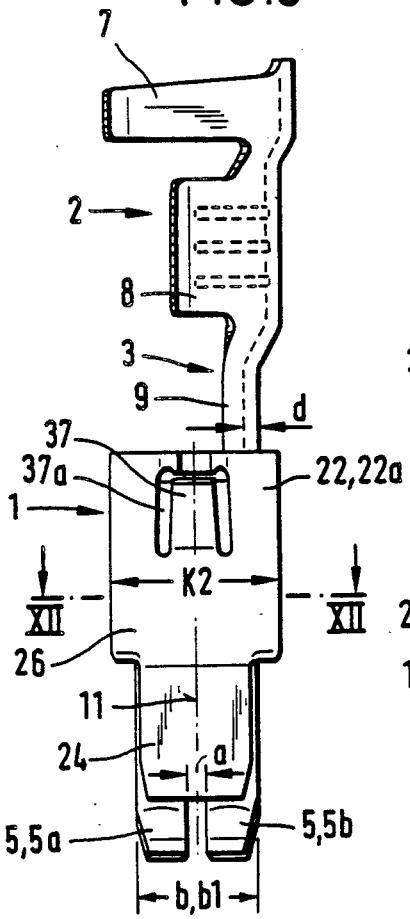
FIG.10
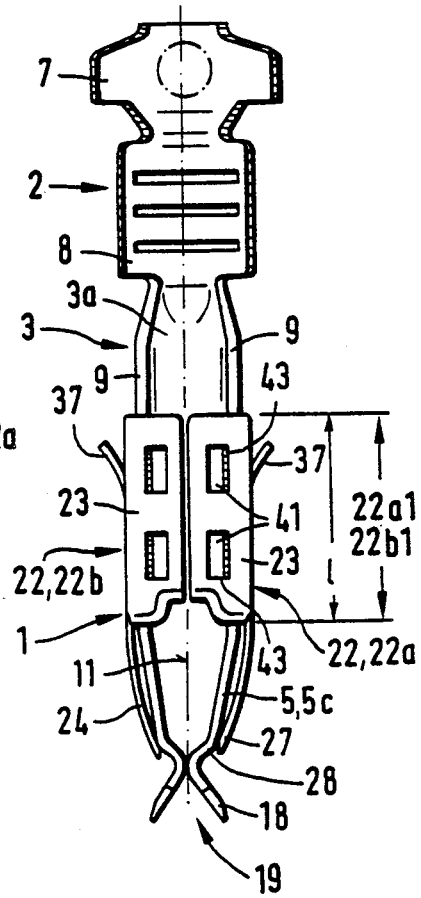
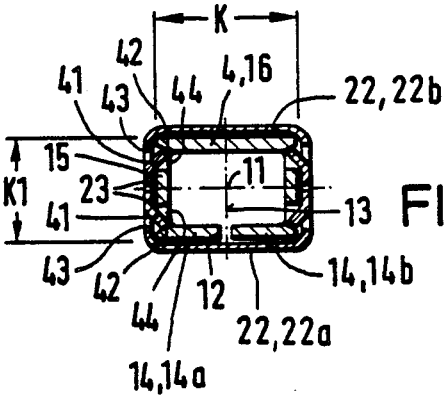
FIG.12

FIG.15
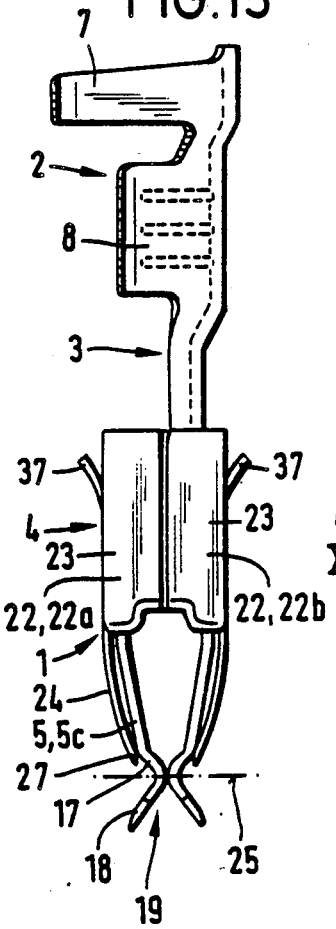
FIG.13
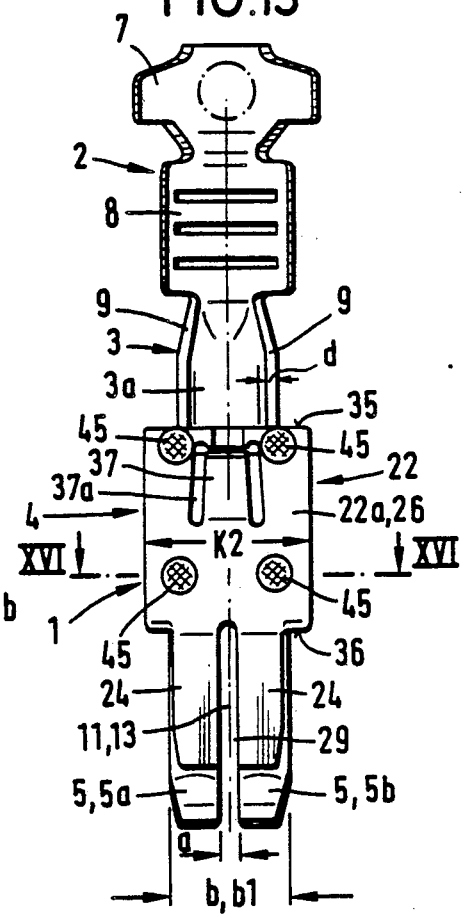
FIG.14
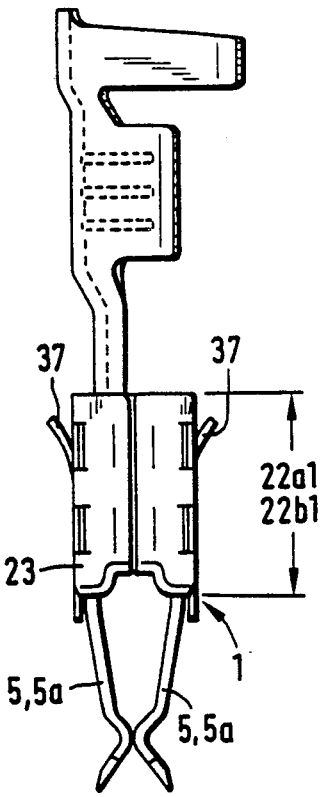
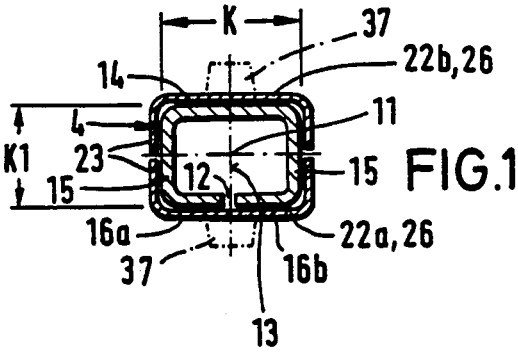
FIG.16

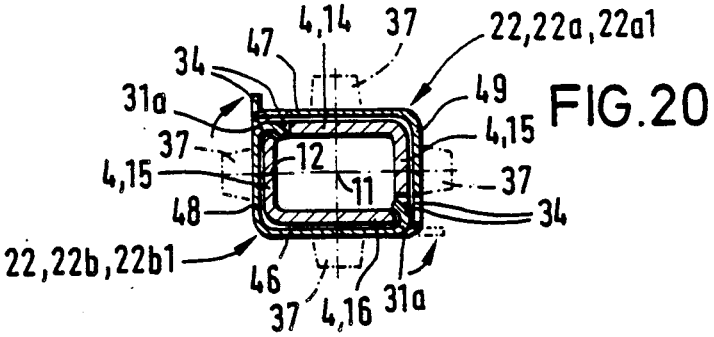
FIG.20
FIG.19
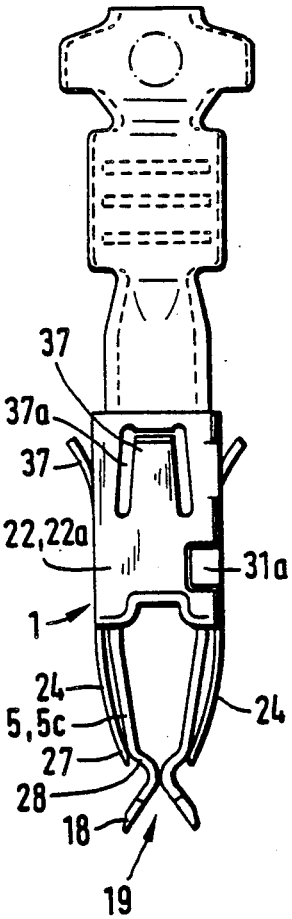
FIG.17
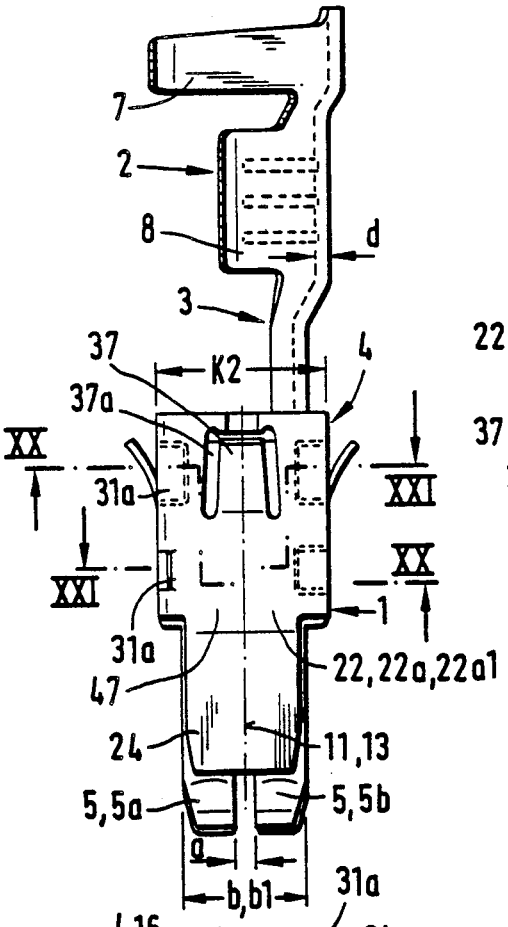
FIG.18
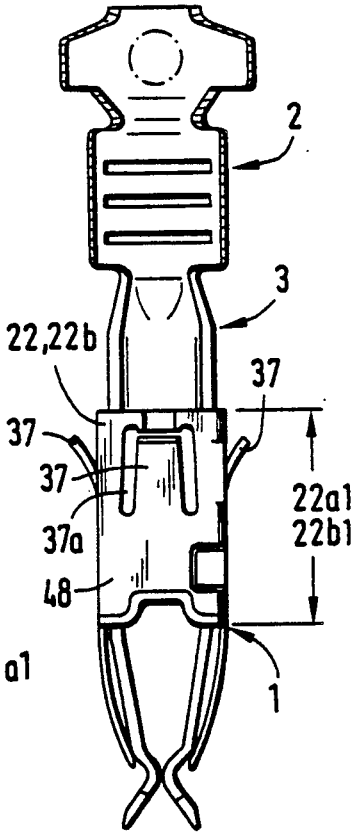
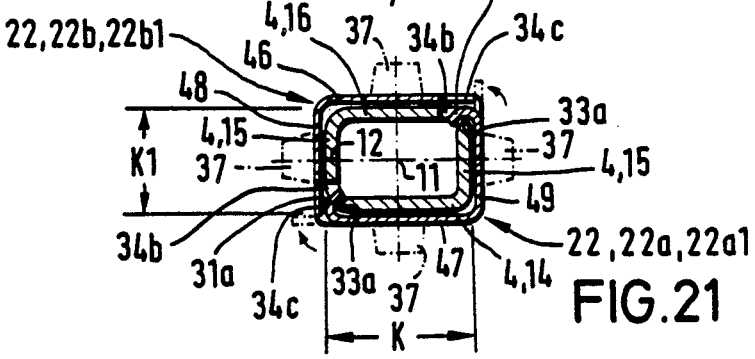
FIG.21

FIG.24
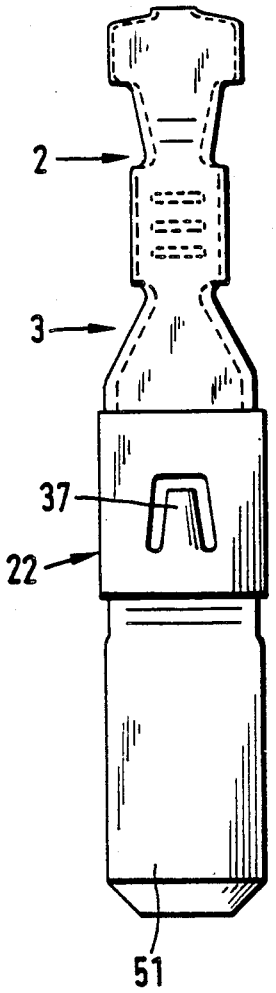
FIG.23
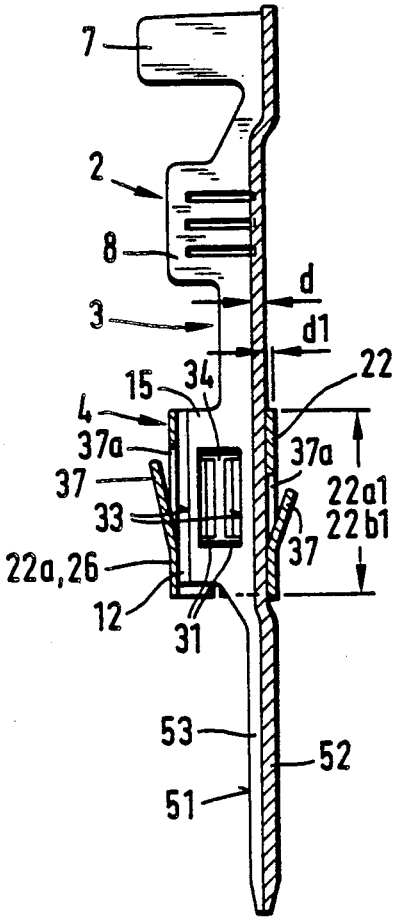
FIG.22
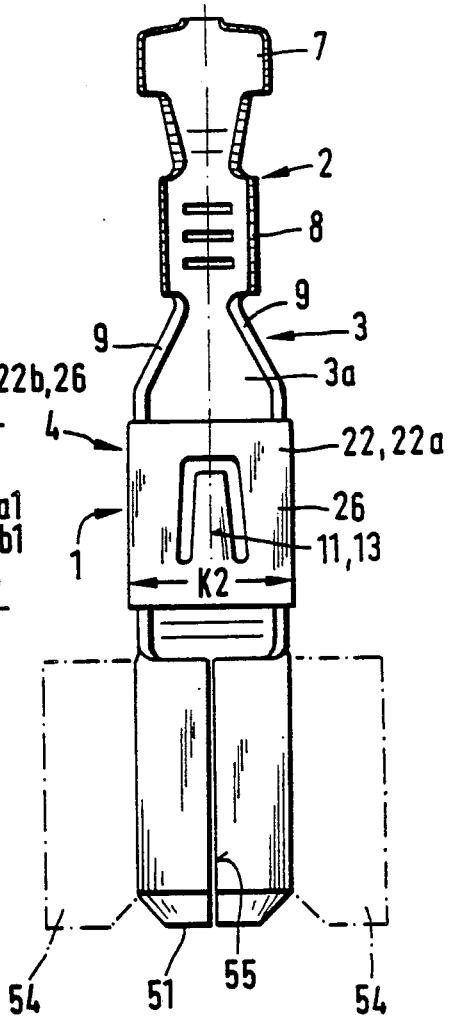
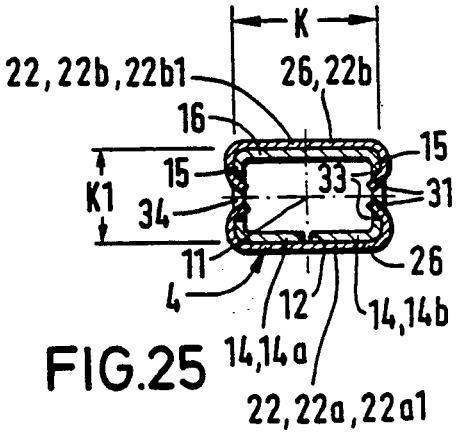
FIG.25

ELECTRICAL CONTACT ELEMENT WITH A COVER SPRING

It is known that one of the methods for stabilizing the contact base involves the positioning and affixing of a cover spring on the contact base, which overlaps said contact base in a position covering its skirt and thus stabilizing its construction, especially against spreading.

There are several processes for mounting the cover spring on the contact base. One such process involves sliding the spring from the front over the contact part and onto the contact base. This involves long slide paths, since the length of a contact part specifically formed by two contact-spring arms is considerable. Furthermore, this sliding on from the front can be accomplished only with difficulty. In addition, when contact spring arms are present, the width of the funnel-shaped expansion at the ends of the contact-spring arms is limited by the length of the transverse rims of the contact base, since, with greater expansion, the cover spring can be slid into position either only after the contact-spring arms are further pressed together or not at all.

It has also been proposed that a cover spring be wound onto the contact base, whereby the sliding on from the front is eliminated. However, such winding is possible only when the spring is made of a soft material. In respect to the highly desirable stabilization, however, a rigid or elastic material is required for the cover spring.

Yet another disadvantage of the known cover springs is the fact that, because of their box-like shape, they can be fabricated only with difficulty and at comparatively great cost.

Fundamental to the invention is an objective of making the fitting of the contact element with the cover spring simpler while also retaining a simple configuration of the spring and its attachment to the contact element.

In the design in keeping with the invention, use is made of a cover spring consisting of two cover-spring parts, which oppose each other in relation to their longitudinal midaxis, or are longitudinally divided into two cover-spring pieces. This not only makes the realization of essentially simpler cross-sectional forms of the cover-spring pieces possible, it also makes it possible to install or mount the cover-spring pieces on the contact base at right angles to the longitudinal axis of the contact element, i.e., from the side, and join them to the contact base. Consequently, the need for sliding the cover spring in from the front is eliminated. As a result, not only is the production of the cover spring or the cover-spring pieces themselves greatly simplified, but also their mounting on the contact element. In this connection, it should be noted that the installation and mounting of the cover-spring pieces from the side requires shorter application distances than are necessary when they are slid in from the front. Consequently, the cover-spring pieces can also be mounted more quickly. Furthermore, the installation or mounting from the side is also much simpler than from the front. Accordingly, the contact element designed in keeping with the invention can be produced at appreciably lower cost.

The invention is described in greater detail below with references to embodiment examples illustrated in the appended drawings.

Depicted are:

FIGS. 1–4, in top view, side view from the left, side view from the right, and cross section on line IV—IV in FIG. 1, respectively, a contact element designed in keeping with the invention.

FIGS. 5–8, in top view, side views from the left and the right, and cross section on line VIII—VIII in FIG. 5, respectively, a second embodiment example of a contact element in keeping with the invention.

FIGS. 9–12, in top view, side views from the left and the right, and cross section on line II—II [sic; XII—XII] in FIG. 9, respectively, a third embodiment example of a contact element in keeping with the invention.

FIGS. 13–16, in top view, side views from the left and the right, and in cross section on line XVI—XVI in FIG. 13, respectively, a fourth embodiment example of a contact element in keeping with the invention.

FIGS. 17–21, in top view, side views from the left and the right, in cross section on line XX—XX in FIG. 17, and in cross section on line XI—XI [sic; XXI—XXI] in FIG. 17, respectively, a fifth embodiment example of a contact element in keeping with the invention.

FIGS. 22–25, in top view, side view from the right, rear view, and cross section, respectively, a contact element designed in keeping with the invention.

In all of the embodiments, the contact element (1) is a one piece, stamped/bent component of sheet metal of a thickness (d) with a crimped part (2), a transition section (3) extending forward therefrom, a contact base (4) extending forward therefrom, and a forward projecting contact part with contact-spring arms (5), which extend forward from the contact base in a forked configuration. The crimped part (2) has two U-shaped, open, rear insulation claws (7) and two front lead claws (8). The transition section (3), U shaped in cross section, connects to the crimped part (2), while the walls (9) of the shafts of the transition section (3) are dimensioned considerably lower than the lead claws (8). The contact base (4) extending in the longitudinal direction of the contact element (1) is a tubular body, rectangular in cross section, with transverse rim lengths (K, Kl), which is formed by two wall parts bent in the manner of a box around the longitudinal midaxis (11) of the contact base (4), which is also the longitudinal midaxis of the contact-spring arms (5), and abutting together with their free longitudinal edges along a longitudinal skirt (12), which extends, in the top (14) of the contact base (4), in the vertical midplane (13) of the contact base (4) and the contact-spring arms (5) encompassing the longitudinal midaxis (11). The contact base (4) also has a side wall (15) and a floor (16). Two pairs **(5*a*, 5*b*) of contact-spring arms are provided, which are separated by an interval (a) and whose contact-spring arms (5) are superimposed in each case. The lower contact-spring arms (5) project in one piece flatly away from the floor (16), and the upper contact-spring arms (5) project in one piece flatly away from the top (14), while each upper contact-spring arm (5) projects out from a part of the top (14), which is divided by the skirt (12). The contact-spring arms (5) of each pair (5*a*, 5*b*) of contact-spring arms—when viewed from the side—extend divergently forward with straight flanks (5*c*), which merge at their front ends into roof like, rounded bends (17), which are adjoined by forward-divergent prongs (18) to form an insertion guide (19)** for a contact pin, which in this embodiment example is a flat plug pin (not depicted).

In the design illustrated in FIGS. 1–4, the transition section (3) is joined to that part of the contact base (4)

shown at the left in FIG. 1, i.e., the transition section (3), which in cross section is U-shaped with a base (3*a*) and the low shank walls (9), is joined to both the left side wall (15) and parts (14*a*, 14*b*) of the top in the vicinity of the long rims of the contact base (4).

The contact-spring element (1) is equipped with a cover spring (22), which is divided longitudinally and thus consists of two cover-spring pieces (22*a*, 22*b*). In this design, the cover-spring pieces (22*a*, 22*b*) are cover-spring base parts, U-shaped in cross section, the free longitudinal edges of which come together with as light separation to form a skirt. The one cover-spring base part (22*a*) is affixed in the form of a U to the top (14) and the other cover-spring base part (22*b*) is affixed in the form of a U to the floor (16), while the side shanks (23) of the base parts (22*a*, 22*b*) overlap the side walls (15) of the contact base (4).

In this embodiment, the cover spring (22) has cover-spring arms (24) for reinforcing the contact-spring arms (5) from the outside. The cover-spring arms (24), opposite each other in a forklike configuration in relation to the contact-spring arms (5), extend flatly forward, while they also converge toward the front and their front ends rest against the outer surfaces of the contact-spring arms (5) in the vicinity of the transverse contact plane (25). The cover-spring arms (24) extend out in one piece from the land walls (26) of the cover-spring bases (22*a*, 22*b*) lying against the top (14) and the floor (16), respectively. In this design, the cover-spring arms (24) are slightly convex, so that only their ends (27) touch the contact-spring arms (5), in this instance in the vicinity of outer corners (28) on the contact spring arms (5) shortly in front of the transverse contact plane (25), which corners are formed by the mirror-image bends (17) in the contact-spring [sic] arms (24).

The width (b) of the cover-spring arms (24) agrees with the width (b1) of the adjoining upper and lower contact-spring arms (5), while the width (b) opposite the corresponding transverse rim length (K2) of the land walls (26) is tapered at both sides, i.e., symmetrically. It also is possible, as indicated in FIG. 1 by a medial slit (29) running from front to rear, that the cover-spring arms (24) be divided into two cover-spring parts at both sides of the longitudinal midaxis (13), so that there is a pair of cover spring arms for each pair (5*a*, 5*b*) of contact-spring arms. In the design depicted in FIG. 1 with visible edges, both of the upper and the lower contact-spring arms (5) are supported by one cover spring arm (24).

In the embodiment illustrated in FIGS. 1–4, the cover-spring base parts (22al, 22bl) are positively secured to the contact base (4) by means of sheet-metal flaps on the cover-spring base parts (22al, 22bl), which are bent in and fit behind anchoring rims on the contact base (4). On the left side—in the top view—of the contact element (1) (see FIG. 2), each cover-spring base part (22al, 22bl) has a sheet-metal flap (31) on each side, which is formed in the associated lateral shank (23) by trim lines (31) extending outward at right angles to their free longitudinal edges. The trim lines (31) extend to shortly in front of the associated land wall (26). The sheet-metal flaps (31) are bent behind longitudinal anchoring rims (33), which are formed by the opposing rims of rectangular cutouts (34) in the side walls (15) of the contact base (4). The cutouts (34) are so dimensioned in the transverse plane that the anchoring rims (33) lie in the plan of the inner surface of the associated top (14) or floor (16). In order to avoid binding, the outer longitudinal edges of the contact base (4) are beveled. By means of the embracement by the sheet metal flaps (31) described above, the cover-spring base parts (22al, 22bl) are fixed on the contact base at right angles to the longitudinal axis (11) of the contact element (1). The cover spring base parts (22al, 22bl) are fixed on the contact base (4) in the longitudinal orientation of the contact element (1) by the fact that the width (c) of the sheet-metal flaps (31) agrees with the associated width of the cutouts (34). Contrary thereto, on the right side of the contact element or the contact base (4), not two opposing sheet-metal flaps (31) but rather four opposing sheet metal flaps (31) and anchoring rims (33) are provided on the back rims (35) and the front rims (36), each lying in a transverse plane, of the contact base (4) and the cover-spring base parts (22al, 22bl). Here the anchoring rims (33) are formed by rear opening or front-opening recesses (34*a*) in the side walls (15), and each of the sheet-metal flaps (31) is formed by only one trim line (32), since there must be no cutouts on the rear and front rims (35, 36). Within the framework of the invention, there may also be only medial (FIG. 2) or front and rear (FIG. 3) sheet-metal flaps (31) and anchoring rims (33).

On at least one side, the cover spring (22) has an engagement arm (37), which is bent obliquely out to the rear from a side wall and serves to lock or secure the contact element (1) in an inserted position inside an undepicted housing, in which the engagement arm snaps behind an engagement rim of the insertion recess of the housing. The engagement arm (37) is formed on the side wall bearing it by way of a U-shaped cut or punch (37*a*), while the tongue thus formed is bent flatly away from this side wall. In the case of the embodiment depicted in FIGS. 1–4, engagement arms (37) formed on the land walls (26) of the cover-spring base parts (22al, 22bl) are provided on two opposing sides.

The embodiment illustrated in FIGS. 5–8, in which identical parts bear identical reference numbers, differs from the embodiment described above by a different arrangement of the crimped part and the positive mounting of the cover-spring pieces or the cover spring base parts (22al, 22bl). In comparison with the design described above, the crimped part (2) is rotated 180° on the longitudinal midaxis (11), so that the floor (3*a*) of the transition section (3) is joined to the right side wall (15) and the shank walls (9) are joined to the top (14) and the floor (16). For the positive mounting of the cover-spring pieces, two sheet-metal flaps (31) and anchoring rims (33) are provided on both sides in the design shown in FIG. 2, while in the present configuration the sheet-metal flaps (31) are arranged on the existing length (1) of the side shanks (23), i.e., both the front and the rear sheet-metal flaps (31) and anchoring rims (33) or cutouts (34) have a separation from the rear rim (35) and the front rim (36), so that two cutouts (34) and two trim lines (32) are used in each case to provide this positive mounting.

In the design shown in FIGS. 9–12, the crimped part (2), together with the transition section (3), is in the same relative position as in FIGS. 5–8. Here the positive mounting of the cover-spring pieces is in the form of engagement arms (41) on the cover-spring base parts (22*a*, 22*b*), which engage behind engagement rims (42) on the side walls (23) of the cover-spring base parts (22al, 22bl). The engagement arms (41) are formed by U-shaped cuts or punches (43) in the side shanks (23) of the cover-spring base parts (22al, 22bl) in such an arrangement that they extend to the associated land wall (26). These engagement arms (41) are bent inward, so that they protrude into cutouts (44) in the associated side walls (15) of the contact base (4). In each case, the delimiting rim of the cutouts (44) facing the floor (16) or the top (14) form the engagement rims (42), behind which the engagement arms (41) fit. As clearly depicted in FIG. 12, the engagement arms (42)—when viewed in cross section—can run at a diagonal slant. It is possible that the engagement arms (41) be bent into place either before or after the mounting of the cover-spring parts onto the contact base (4). In the first instance, the engagement arms (41), already bent inward during the mounting, are bent outward by the side walls (15), while they automatically snap into their final mounting position by virtue of their elasticity. In the design here depicted, each side shank (23) has two engagement arms (42) with their associated engagement rims (42) lying in successive alignment in the longitudinal direction. However, it is also possible that the engagement arms (41) and the locking rims (42) be arranged in the configurations illustrated in FIGS. 1–8.

The design depicted in FIGS. 13–16 differs by another arrangement of the crimped part (2) and the transition section (3) and by another attachment of the cover-spring pieces to the contact base (14) [sic]. The crimped part (2) and the transition section (3) are rotated by 90° in comparison with the designs already described in such a way that, in the top view in FIG. 13, the crimping collars (7, 8) are open toward the top, while the top (3*a*) and the side walls (9) of the transition section (3) are joined to the floor (16) and the side walls (15) of the contact base (4). In this configuration, instead of a positive mounting, a releasable connection of the cover-spring base parts (22al, 22bl) to the contact base (4) is provided by welding or soldering at prescribed connection points. Preferably, four connection points (45) are provided, in the vicinity of the existing corners between the land walls (26) and the floor (16) or top (14), for each cover-spring base part (22al, 22bl).

In the design illustrated in FIGS. 17–21, the crimped part (2) and the transition section (3) are in a position as depicted in FIGS. 5–8 or 9–12. Here the cover spring (22) is diagonally divided to produce two L-shaped or angular cover-spring pieces (22*a*, 22*b*), the cover-spring base parts (22al, 22bl) of which are individually formed by a flat floor or top shank (46, 47) and a lateral shank (48, 49) bent at a right angle thereto. The cover spring arms (24) extend forward from the floor shank (46) and the top shank (47) as described above. The floor or top shank (46, 47) and the lateral shanks (48, 49) extend in each case over the associated transverse rim length (K, Kl) of the contact base (4), while they may also cover the free rims of the adjoining shanks, as illustrated in FIG. 21. The positive mounting for the cover spring base parts (22al, 22bl) is formed by flexible sheet-metal flaps (31*a*) projecting from and in the plane of the free longitudinal edges of the floor or top shank (46, 47) and the lateral shanks (48, 49), which flaps are bent into cutouts (34*b*) situated in the associated corner areas of the contact base (4) and whose delimiting edges facing the associated sheet-metal flaps (31*a*) form the anchoring rims (33*a*) for the incurved sheet-metal flaps (31*a*). In order that the sheet-metal flaps (31) can be bent in from their initial position shown in FIGS. 20 and 21, appropriately dimensioned recesses (34*c*), which extend out to the free longitudinal edges, are provided in the adjoining lateral shanks (46, 48; 47, 49) of the other cover-spring piece (22*a*, 22*b*) facing the associated sheet-metal flaps (31*a*). The sheet-metal flaps (31*a*) are bent in through the recesses (34*c*).

As clearly depicted in FIGS. 20 and 21 in conjunction with the section details in FIG. 17, each cover-spring base part (22al, 22bl) has, on the shaft in its front section and on its shaft in the rear section, a sheet-metal flap (31*a*) with an associated anchoring rim (33*a*). Preferably, the sheet-metal flap (31*a*) on the longer shank (floor shank (46), top shank (47)) is in the forward area, while the sheet-metal flap (31*a*) on the shorter side shank (48, 49) is in the rear area. With this design, the flexible flap (31*a*) and cutout (34*b*) belonging to a given cover-spring piece (22*a*, 22*b*) are in diagonal opposition.

The engagement arms (37) in the design illustrated in FIGS. 17–21 can be provided either on one or on both cover-spring base parts (22al, 22bl), i.e., on one base shaft or on both base shafts, whereby one, two opposing, or four opposing engagement arms (37) can be realized. A further difference from the designs previously described is the fact that the skirt (12) of the contact base (4) is not located in the top (14) but rather in a side wall (15), in this case the left side wall (15), preferably centered in this sidewall. Here it should be noted that the crimped part (2) and the transition section (3) are arranged opposite the skirt (12). Thus, the transition section (3) is joined to the right side wall (15) and to the top (14) and the floor (16) in the area of the right longitudinal edge.

In the embodiment shown in FIGS. 22–25, the contact part of the contact element (1) is not formed by contact-spring arms but rather by a flat plug pin (51), which extends forward in one piece from the floor (16) of the contact base (4), while the floor (16) extends over the greater transverse rim length (K) as in the designs already described. The flat plug pin (51) is designed in two layers, while the lower layer (52) represents an extension of the floor (16) and the upper layer (53) is formed by folding in the lateral folding flaps (54) bonded to the longitudinal edges of the lower layer (52), which flaps are indicated in FIG. 22 in the unfolded position and in the folded position along medial skirt rims (55) with their longitudinal edges overlapping. The flat plug pin (51) is pointed at the front by tapered surfaces on all sides. In their configuration and arrangement, the contact base (4) and the two-piece cover spring (22) agree with the designs shown in FIGS. 1–4, and sheet-metal flaps (31) and anchoring rims (33) are provided as depicted in FIG. 2, while the former are bent into the cutouts (34) forming the anchoring rims (33). As in all of the designs—the lateral shanks (23) of the cover-spring pieces (22*a*, 22*b*) can be dimensioned so short that the sheet-metal flaps (31) protrude as projections from their longitudinal edges. As regards the engagement arms (37), however, another difference must be described, which consists of the fact that the engagement arms (37) projecting from the land wall (26) of the lower cover-spring base part (22*b*) is shorter than the opposing engagement arm (37).

In this embodiment, the lower layer (52) of the flat plug pin (51), immediately in front of its union with the contact base (4), is bent parallely downward by a measure (e) agreeing with the thickness (d1) of the associated cover-spring base part (22*b*), so that the undersurface of the flat plug pin (51) and the undersurface of the land wall (26) lie in the same plane.

In all of the embodiments described above, the contact element (1) and the two pieces of the cover spring (22) are formed as a one-piece punched/bent part, while the contact element (1) is made of a good electrically conductive material and the pieces of the cover spring (22) are preferably made of sheet steel. While ensuring good elasticity due to the high stability of steel, this also guarantees good flexural strength for the cover-spring arms (24) and the engagement arms (37).

In all of the embodiment examples, the individual designs and arrangements of the crimped part (2), the contact base (4), and the cover springs (22), as well as their positive mountings and the contact parts, can be realized in combinations differing from those described. Such possible combinations can be advantageous in view of the stepwise production of the contact elements in a punching/bending press while observing the sequential cutting and shaping steps. The described positions of the crimped part (2) are advantageous in the interest of stability, on the one hand, and equally so for reason of the stepwise production in the punching-/bending press, on the other hand, and especially so when the punching/bending press is operated in tandem with a crimping tool and a feed device for the lead ends to be crimped. The same holds true for the designs and arrangements of the cover spring (22). Not only is a stable configuration of the cover-spring base parts and the contact-spring arms achieved, also both parts of the cover spring can be simply and advantageously positioned and joined to the contact base (4), preferably from above and below, from the side, i.e., at right angles to the longitudinal midaxis (11). This is also of great significance for a punching/bending press, since more space is available above and below the approach plane for the sheet-metal strips for positioning feed and mounting devices for the positioning and mounting of the parts of the cover spring from above and below.

In all of the embodiments described above, the pieces of the cover spring (22) or the cover-spring base parts (22al, 22bl) can be designed, as illustrated in FIG. 14, without cover-spring arms (24).

We claim:

1. Electrical contact element which forms a punched and bent component of sheet metal with a connector part particularly formed by a crimped part, with a tubular contact base extending forward therefrom with a substantially longitudinal skirt in a tubular base wall of the skirt, with a contact part extending forward from the contact base, and with a cover spring provided on and affixed to the contact base, characterized by the improvement comprising:

the cover spring (22) is longitudinally divided into two cover-spring pieces.

each cover-spring piece (22*a*, 22*b*) has a cover-spring base part (22al, 22bl), and the cover-spring base parts (22al, 22bl) are affixed to the contact base (4) opposite each other in relation to the longitudinal midaxis (11) of the contact base (4).

2. Electrical contact element according to claim 1, characterized by the fact that the form of the cover-spring base parts (22al, 22bl) is matched to the form of the associated outer contact surface of the contact base (4).

3. An electrical contact element according to claim 1, characterized by the fact that the contact base (4) is four-sided and substantially rectangular in cross section.

4. An electrical contact element according to claim 1, characterized by the fact that the cover-spring pieces (22*a*, 22*b*) are identical or mirror-image parts.

5. An electrical contact element according to claim 1, characterized by the fact that the contact base (4) is formed by two tubular floor parts bent toward each other and running along a longitudinal skirt (12), and the skirt (12) is arranged in one of two side walls (15) of the contact bore.

6. An electrical contact element according to claim 1, characterized by the facts that at least one of the two cover-spring base parts (22al, 22bl) is formed on the land wall (26) by U-shaped cuts (37*a*) and that engagement tongues (37) bent obliquely outward toward the rear are provided.

7. An electrical contact element according to claim 1, characterized by the fact that the cover-spring pieces (22*a*, 22*b*) are made of steel.

8. An electrical contact element according to claim 1, characterized by the fact that each of the cover-spring base parts (22al, 22bl) is U-shaped in cross section.

9. An electrical contact element according to claim 8, characterized by the fact that lateral shanks of the cover-spring base parts (22al, 22bl) extend almost over half the length (Kl) of associated transverse rims of the contact base (4).

10. An electrical contact element according to claim 8, characterized by the fact that engagement arms (41) are formed by U-shaped means (43) on sidewalls of the base part or on lateral shanks (23) of the cover spring parts (22*a*, 22*b*), which are slightly bent outward and fit behind engagement rims (42) formed by cutouts (44) on the lateral shanks (23) of the cover-spring base parts (22al, 22bl) or on the side walls (15) of the contact base (4).

11. An electrical contact element according to claim 1, characterized by the facts that the cover-spring base parts (22al, 22bl) are angular or L-shaped in cross section, and shanks (46, 48, 47, 49) of the cover-spring base parts (22al, 22bl) extend over the length (K, Kl) of associated transverse rims of the contact base (4).

12. An electrical critical contact element according to claim 6, characterized by the fact that on one lateral shank (46, 48, 47, 49) of the angular or L-shaped cover-spring base parts (22al, 22bl), an engagement tongue (37) formed by a U-shaped cut (37*a*) and bent obliquely outward toward the rear is provided.

13. An electrical contact element according to claim 1, characterized by the fact that strip-like contact spring arms (5) extend forward in one piece from a broad side of a floor (16) and a top (14) of the contact base, flanks (5*c*) of which converge forward and either come together or are slightly separated in a contact plate (25) at a right angle to the longitudinal midaxis (11) of the contact-spring arms (5).

14. An electrical contact element according to claim 13, characterized by the fact that two contact-spring arms (5) with a separation (a) extend forward from the floor (16) and top (14) of the contact base (4) to form pairs (5*a*, 5*b*) of contact-spring arms arranged at both sides of a vertical, longitudinal midplane (13).

15. An electrical contact element according to claim 13, characterized by the fact that at least one strip-like cover-spring arm (24) extends forward from each associated cover-spring base part (22al, 22bl), which makes contact with the associated contact-spring arm (5) in the vicinity of the contact plane (25).

16. An electrical contact element according to claim 15, characterized by the fact that each of the cover-spring arms (24) extends out from a land wall (26) of the associated cover-spring base part (22al, 22bl) located on a broad side of the base (4).

17. An electrical contact element according to claim 15, characterized by the fact that the cover-spring arms (24) extend out from opposing shanks (46, 47) of the cover-spring base parts (22al, 22bl).

18. An electrical contact element according to claim 17, characterized by the fact that the cover-spring arms (24) extend out from floor and top shanks (46, 47) of the angular or L shaped cover-spring base parts (22al, 22bl) mounted on a broad side of the contact base (4).

19. An electrical contact element according to claim 18, characterized by the fact that, from broadside land walls (26) of the U-shaped cover-spring base parts (22al, 22bl) or from broadside top and floor shanks (46, 47) of the cover-spring base parts (22al, 22bl), at least one cover-spring arm (24) of comparable width (bl) extends forward for the associated contact-spring arms (5), each of which supports the associated contact spring arms (5) on the outside and is matched to the width of the latter.

20. An electrical contact element according to claim 1, characterized by the fact that the cover-spring base parts (22al, 22bl) are positively mounted on the contact base (4).

21. An electrical contact element according to claim 20, characterized by the fact that the positive mounting is formed by sheet-metal flats (31, 31*a*) formed on the cover-spring base parts (22al, 22bl) and bent behind engagement rims (33, 33*a*) on the contact base (4), which rims are formed by recesses (34, 34*a*) on the contact base (4).

22. An electrical contact element according to claim 21, characterized by the fact that the sheet-metal flats (31) are formed by trim lines (32) running at right angles to free longitudinal rims of the cover-spring base parts (22al, 22bl).

23. An electrical contact element according to claim 21, characterized by the fact that the sheet-metal flaps (31, 31*a*) protrude from free longitudinal rims of the cover-spring base parts (22al, 22bl).

24. An electrical contact element according to claim 21, characterized by the fact that each sheet-metal flap (31) aligns with its own recess (34, 34*a*).

25. An electrical contact element according to claim 21, characterized by the fact that the sheet-metal flaps (31*a*) protrude from free peripheral rims of lateral shanks (46, 48, 47, 49) of the cover-spring base parts (22al, 22bl), are bent into diagonally opposing cutouts (34*b*) in the contact base (4), and there engage behind locking rims (33*a*) formed by the cutouts (34*b*).

26. An electrical contact element according to claim 25, characterized by the fact that a recess (34*c*) for the sheet-metal flap (31*a*) to be inserted is provided in the vicinity of the cutout (34*b*) in the lateral shank (46, 48, 47, 49) on the other cover-spring base part (22al, 22bl) adjoining the lateral shank bearing the sheet-metal flap (31*a*).

27. An electrical contact element according to claim 1, characterized by the fact that the cover-spring base parts (22al, 22bl) are welded or soldered to the contact base (4) at predetermined points (45).

28. Electrical contact element according to claim 27, characterized by the fact that four spot-weld or spot-solder points (45) are provided in each corner area of the broad side of the contact base (4).

29. An electrical contact element according to claim 1, characterized by the fact that the connector part is formed by a crimped part (2) with crimping collars (7, 8), which is joined to the contact base (4) by a transition section (3) which is U-shaped in cross section.

30. Electrical contact element according claim 29, characterized by the fact that the transition section is joined to the top (16) of the contact base (4) by open crimping collars (7, 8) open toward the top.

31. An electrical contact element according to claim 29, characterized by the fact that the transition section (3) is joined to a side wall (15) of the contact base (4) in a position of the crimping collars (7, 8), in which the transition section faces the longitudinal midaxis (11) of the contact element (1).

32. An electrical contact element according to claim 29, characterized by the fact that side walls (9) of the transition section (3) are joined to associated walls (14, 15, 16) of the contact base (4).

* * * * *

UNITED STATES PATENT AND TRADEMARK OFFICE

CERTIFICATE OF CORRECTION

PATENT NO. : 5,094,636

DATED : March 10, 1992

INVENTOR(S) : BERND ZINN ET AL.

It is certified that error appears in the above-identified patent and that said Letters Patent is hereby corrected as shown below:

In Claim 13, line 6 (col. 8, line 51), change "plate" to --plane--

In Claim 21, line 3 (col. 9, line 30), change "flats" to --flaps--

In Claim 22, line 2 (col. 9, line 37), change "flats" to --flaps--

Signed and Sealed this

Fifteenth Day of June, 1993

*Attest:*

Michael K. Kirk

MICHAEL K. KIRK

*Attesting Officer*

*Acting Commissioner of Patents and Trademarks*